US006932576B2

(12) United States Patent
Bird

(10) Patent No.: US 6,932,576 B2
(45) Date of Patent: Aug. 23, 2005

(54) QUICK CONNECT CEILING FAN BLADE

(75) Inventor: Gregory Michael Bird, Colliersville, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/406,100

(22) Filed: Apr. 1, 2003

(65) Prior Publication Data

US 2004/0197193 A1 Oct. 7, 2004

(51) Int. Cl.[7] ..... F04D 29/34
(52) U.S. Cl. ..... 416/207; 416/206; 416/214 R
(58) Field of Search ..... 416/5, 210 R, 416/205, 206, 207, 204 R, 214 R, 220 A, 221

(56) References Cited

U.S. PATENT DOCUMENTS

| | | | | |
|---|---|---|---|---|
| 4,187,056 A | | 2/1980 | Schwinn et al. | 416/207 |
| 4,197,054 A | | 4/1980 | Morrill | 416/93 |
| 4,245,960 A | | 1/1981 | Matthews | 416/244 |
| 5,102,302 A | | 4/1992 | Schilling et al. | 416/224 |
| 5,354,176 A | | 10/1994 | Schilling et al. | 416/204 |
| 5,458,464 A | | 10/1995 | Lee | 416/210 |
| 5,944,486 A | * | 8/1999 | Hodgkins, Jr. | 416/210 R |
| 5,951,253 A | | 9/1999 | Gajewski | 416/214 |
| 5,954,449 A | | 9/1999 | Wu | 403/315 |
| 5,980,353 A | | 11/1999 | Wu | 446/210 |
| 6,010,306 A | | 1/2000 | Bucher et al. | 416/210 |
| 6,022,191 A | | 2/2000 | Moore et al. | 416/134 |
| 6,039,540 A | | 3/2000 | Wu | 416/210 |
| 6,149,388 A | | 11/2000 | Liao | 416/210 |
| 6,155,787 A | | 12/2000 | Hodgkins, Jr. | 416/210 |
| 6,210,117 B1 | | 4/2001 | Bucher et al. | 416/210 |
| 6,250,885 B1 | | 6/2001 | Gajewski | 416/214 |
| 6,352,409 B1 | * | 3/2002 | Blateri et al. | 416/207 |
| 6,371,729 B1 | * | 4/2002 | Tseng | 416/210 R |
| 6,382,917 B1 | | 5/2002 | Zuege | 416/210 |
| 6,390,777 B1 | | 5/2002 | Kerr, Jr. | 416/204 |
| 6,508,629 B2 | | 1/2003 | Kerr, Jr. | 416/210 |
| 6,585,488 B1 | * | 7/2003 | Bucher et al. | 416/210 R |
| 6,669,446 B2 | * | 12/2003 | Hodgkins, Jr. | 416/210 R |

FOREIGN PATENT DOCUMENTS

JP 62-218694 A * 9/1987

* cited by examiner

*Primary Examiner*—Christopher Verdier
(74) *Attorney, Agent, or Firm*—Baker Donelson

(57) ABSTRACT

A ceiling fan (10) is disclosed having a motor housing (11) with an electric motor to which is mounted an annular array of blade irons (14) each having a blade (15) mounted thereto. Each blade has two, catch mounting holes (17) and a fastener mounting hole (18) extending therethrough. Each blade iron (14) has a blade mounting portion (23) and a removable blade fastener (24). The blade mounting portion (23) has a top surface (26), two stationary mounting catches (27), and a fastener receiver (28) that is configured to receive fastener (24). Each catch has a generally vertical portion (31) and a top, horizontal portion (32) The horizontal portion (32) is spaced a select distance from the top surface (26) through the height of the vertical portion (31) so as to catch snugly the blade (15) therebetween. The fastener (24) extends through the fastener mounting hole 18 and into the fastener receiver (28). The blade may be mounted to the blade iron by passing the catches through the catch mounting holes, sliding the blade outboard and then passing the fastener through the fastener mounting holes of the blade and into the fastener receiver in the blade iron.

8 Claims, 3 Drawing Sheets

QUICK CONNECT CEILING FAN BLADE

TECHNICAL FIELD

This invention relates to ceiling fans and more specifically to mechanisms by which their fan blades are mounted and dismounted.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the fan housing or blade irons for campactness. The housing is normally mounted in suspension from the ceiling through a downrod and then the blades are mounted to the blade irons. To do this, the blades have been mounted to the blade irons with screws or bolts. This has been cumbersome and tedious as the installer has had to be elevated on a ladder or platform and work above his head. This work has entailed aligning the mounting holes of the blade and blade iron and torquing the screws all while having to hold the blade above his head and often under poor lighting conditions. For blade replacement, the same task has been involved.

Accordingly, it is seen that a need remains for a ceiling fan capable of having its blades mounted and dismounted in a more efficient and easier manner. It is to the provision of such therefore that the present invention is primarily directed.

SUMMARY OF THE INVENTION

In a preferred form of the invention a ceiling fan comprises an electric motor, an annular array of blade irons mounted to the motor, each blade iron has at least one catch and at least one fastener receiver, a ceiling fan blade associated with each blade iron of the annular array of blade irons, each blade having at least one catch mounting hole and at least one fastener mounting hole, and a fastener having a stop portion configured to abut a fan blade surface opposite the blade iron, and a locking portion configured to extend through the blade fastener mounting hole and be releasably received within the fastener receiver. With this construction, the blades may be mounted to the blade irons by passing the catch through the fan blade catch mounting hole and then passing the fastener through the fan blade fastener mounting hole and into locking engagement with the blade iron fastener receiver.

DETAILED DESCRIPTION

Figure 1:
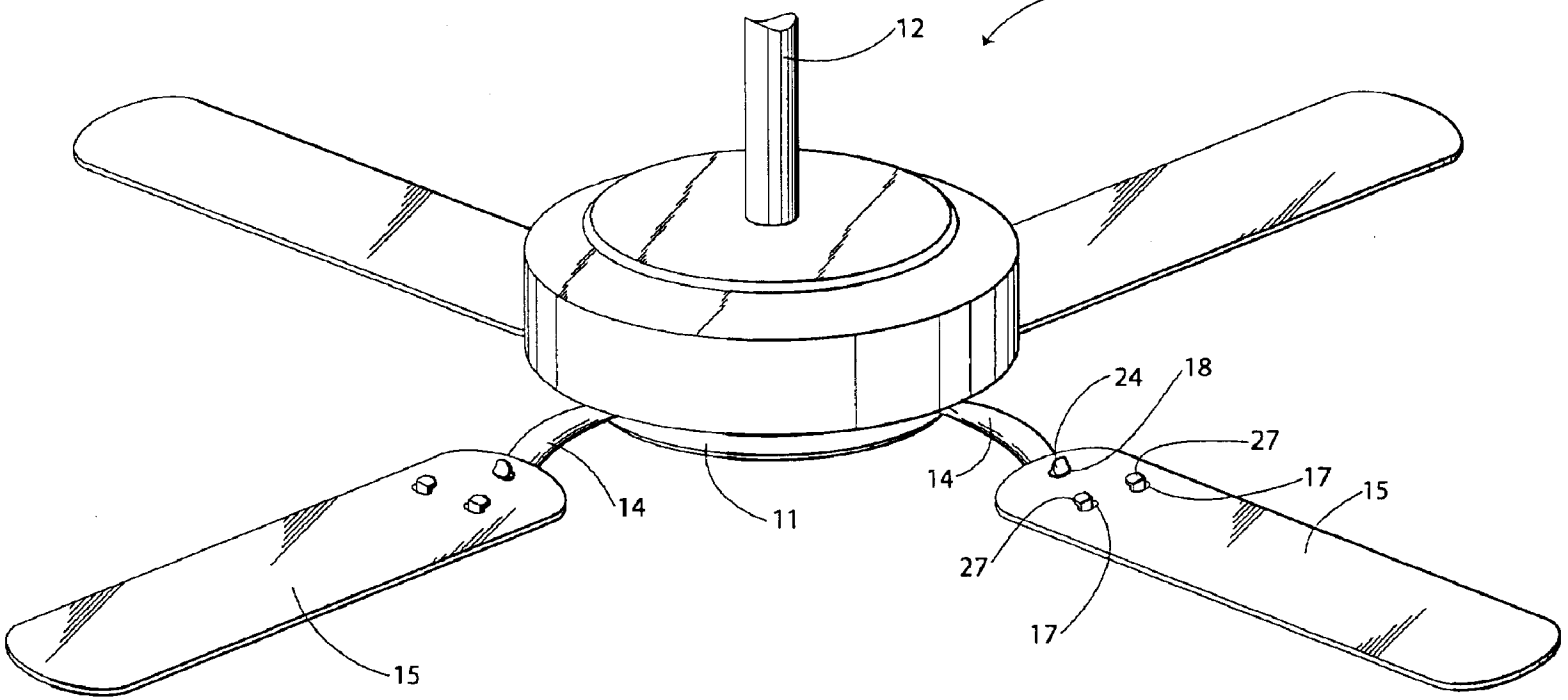
FIG. 1 is a perspective view of the top of a ceiling fan that embodies principles of the invention in its preferred form.
Figure 2:
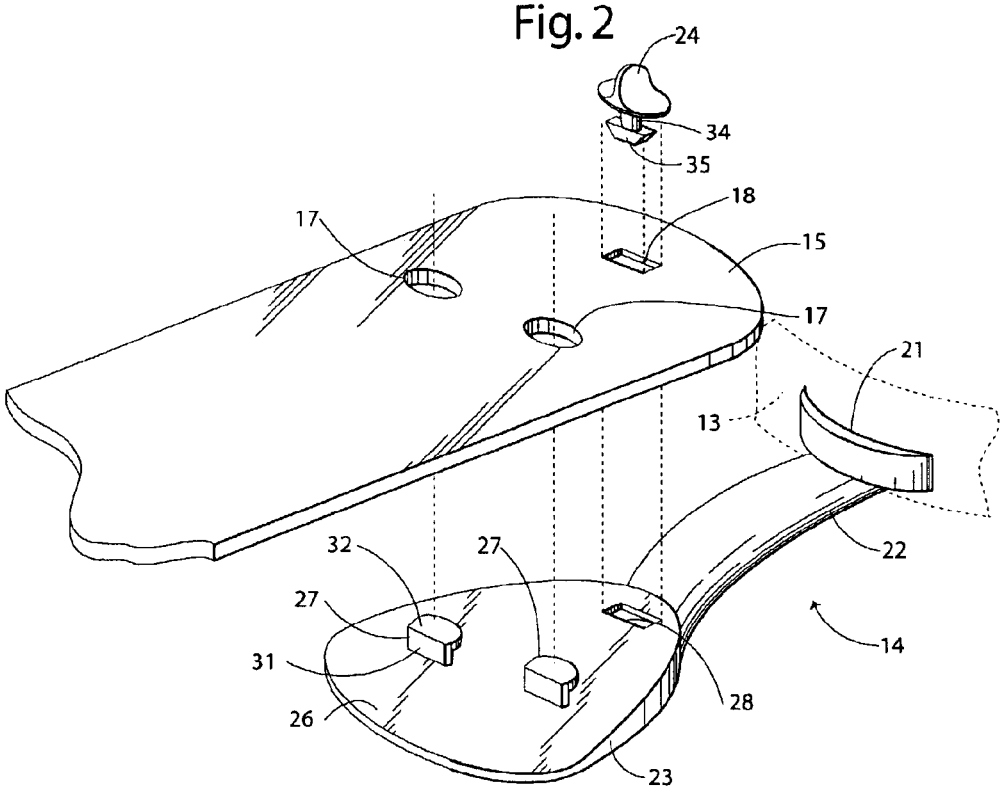
FIG. 2 is an exploded view of parts employed in mounting one of the fan blades.

With reference next to the drawings, there is shown a ceiling fan 10 having a motor housing 11 suspended from an unshown ceiling by a downrod 12. An electric motor 13 is mounted within the housing 11 and connected to a source of electric power by wires that extend through the downrod 12. The motor rotatably drives an annular array of blade irons 14, each having a blade 15 mounted thereto. Each blade has two, catch mounting holes 17 and a fastener mounting hole 18 extending therethrough.

Each blade iron 14 has a motor mounting flange 21 configured to be coupled with the electric motor 13 for rotation, a neck 22, a blade mounting portion 23, and a removable blade fastener 24. The blade mounting portion 23 has a top surface 26 facing the ceiling, two stationary mounting catches 27 extending from the top surface 26, and a fastener receiver or receiving slot 28 extending into the top surface 26 that is configured to receive fastener 24. Each catch 27 has a generally vertical portion 31 and a top, horizontal portion 32. The horizontal portion 32 is spaced a select distance from the top surface 26 through the height of the vertical portion 31 so as to catch snugly the blade 15 therebetween. The fastener 24 extends through the fastener mounting hole 18 and into the fastener receiver 28. Typically, this type of fastener 24 is locked in position with the fastener receiver 28 through a quarter turn or rotation of the fastener 24.

In use, the downrod 12 is coupled to the ceiling with the motor housing 11 coupled to the opposite end of the downrod with the blade irons 14 already mounted to the motor 13. Each blade 15 is mounted to a corresponding blade iron by positioning the pair of catches 27 of a blade iron 14 through the catch mounting holes 17 of the blade 15. The blade 15 is then slid outboard so that the fastener mounting hole 18 becomes aligned with or in register with the fastener receiver 28. The term outboard is meant to represent movement away from the fan's axis of rotation. The outboard movement of the blade 15 causes the blade to be captured between the blade iron top surface 26 and the horizontal portion 32 of the catches 27. Next, the fastener 24 is passed through the blade fastener mounting hole 18 and into the fastener receiver 28. The fastener 24 is then rotated to a locked position locking the fastener 24 with the fastener receiver 28. The fastener 24 prevents the upward movement of the blade 15 away from the underlying blade iron 14.

With the fastener 24 locked in position that blade 15 is captured between the two catches 27 and the fastener 24, thereby preventing lateral movement of the blade 15 relative to the blade iron 14, i.e., locking the position of the blade 15 upon the blade iron 14. This locking of the blade may be accomplished simply and quickly by a single installer as this may be done without the use of tools and without screwing in multiple mounting screws, the problem long associated with mounting the blades of ceiling fans of the prior art.

Figure 3:
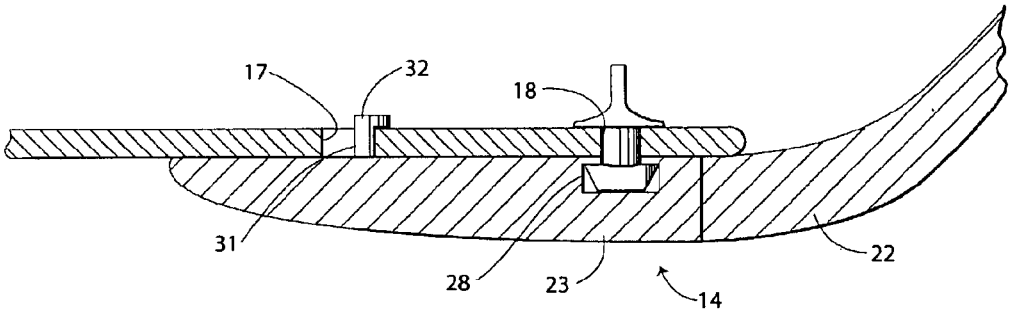
FIG. 3 is cross-sectional view of the parts of FIG. 2.

The fastener 24 may have an neck portion 34, above the locking portion 35, which is oblong so that it fits through the fastener mounting hole 18 and is then rotated to closely abut the fastener mounting hole, in the direction along the length of the blade, when rotated to the locking position, as best shown in FIG. 3.

Figure 4:
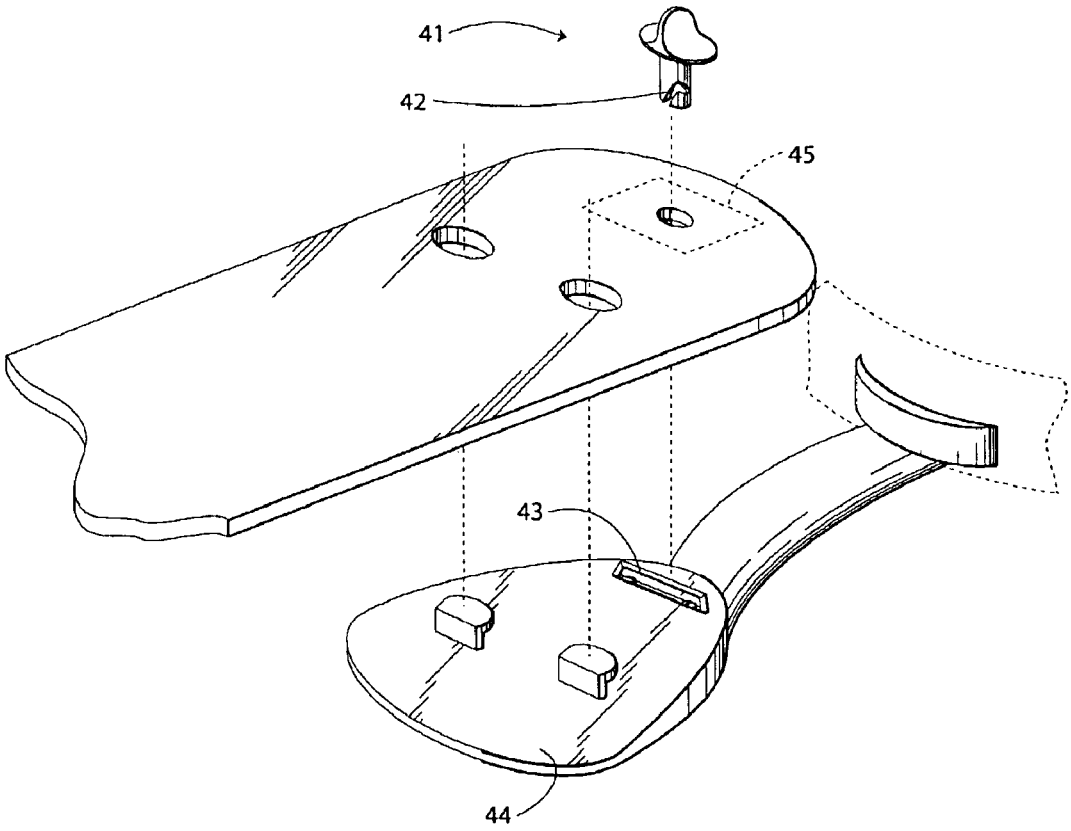
FIG. 4 is an exploded view of the invention in another preferred form.

Of course, many other similar fasteners may be utilized as an alternative to the one shown in the preferred embodiment. One example of an alternative fastener is shown in FIG. 4. Here the fastener 41 has one or more grooves 42 therein configured to mate with a spring biased bar 43 mounted to the blade iron. The bottom side of the blade would include a recess 45 to insure that the blade remains flush with the underlying blade iron, or in the alternative, the blade iron would be recessed in the area of the bar 43 so that the bar lies beneath the top surface 44 of the blade iron. Another alternative may be a conventional fastener having flattened end portions designed to mate with spring clamps. These alternatives may include a post extending from the blade iron upon which a mating stop is coupled which is sized to have a portion fit snugly within the fastener mounting hole. As such, the post is to be considered the fastener receiver while the stop is to be the fastener.

The blade 15 may likewise be dismounted from the blade iron 14 by simply rotating and removing the fastener 24 and moving the blade inboard and then upwardly.

It should be understood that the present invention may utilize only one catch 27 or more than two catches as an alternative to the preferred embodiment. Similarly, the invention may utilize more than the one fastener 24 shown in the preferred embodiment.

It thus is seen that a quick connect ceiling fan blade is now provided which enables the blade to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A ceiling fan comprising, an electric motor;

an annular array of blade irons mounted to said motor, each said blade iron having at least one catch and at least one fastener receiver;

a ceiling fan blade associated with each said blade iron of said annular array of blade irons, each said blade having at least one catch mounting hole and at least one fastener mounting hole; and a rotatable fastener having a stop portion configured to abut a fan blade surface opposite said blade iron and having a hand gripping portion, and a locking portion configured to extend through said blade fastener mounting hole and be releasably received within said fastener receiver, said rotatable fastener being rotatable between a locked position locking said blade to said blade iron and an unlocked position unlocking said blade from said blade iron, whereby each respective blade may be mounted to each respective blade iron by passing the catch through the fan blade catch mounting hole and then passing the fastener through the fan blade fastener mounting hole and into locking engagement with the blade iron fastener receiver, and whereby an operator may grasp and operate the fastener.

2. The ceiling fan of claim 1 wherein said catch has a vertical portion extending through said catch mounting hole and a flange portion extending from said vertical portion in a position to overlay said fan blade surface opposite the blade iron.

3. The ceiling fan of claim 2 wherein said flange portion extends towards said fastener.

4. A ceiling fan comprising, an electric motor;

an annular array of blade irons mounted to said motor, each said blade iron having at least one catch;

a ceiling fan blade associated with each said blade iron of said annular array of blade irons, each said blade having at least one catch mounting hole and at least one fastener mounting hole; and a rotatable fastener adapted to partially extend through said fastener mounting hole and to be coupled to each said blade iron to releasably lock each said ceiling fan blade to one said blade iron, said fastener having a stop portion configured to abut a fan blade surface opposite said blade iron, a hand gripping portion and a locking portion configured to extend between said stop portion and said blade iron through said blade fastener mounting hole, said rotatable fastener being rotatable between a locked position locking said blade to said blade iron and an unlocked position unlocking said blade from said blade iron, whereby each respective blade may be mounted to each respective blade iron by passing the catch through the fan blade catch mounting hole and then locking the fastener to the blade iron.

5. The ceiling fan of claim 4 wherein said catch has a vertical portion extending through said catch mounting hole and a flange portion extending from said vertical portion in a position to overlay said fan blade surface opposite the blade iron.

6. The ceiling fan of claim 5 wherein said flange portion extends towards said fastener.

7. A ceiling fan comprising, an electric motor;

an annular array of blade irons mounted to said motor, each said blade iron having at least one catch;

a ceiling fan blade associated with each said blade iron of said annular array of blade irons, each said blade having at least one catch mounting hole and a fastener mounting hole therethrough, and a fastener associated with each said blade iron, each fastener having a first portion coupled to said blade iron and a second portion adapted to mate with said first portion to releasably lock one said blade to one said blade iron, said fastener having a stop portion configured to abut a fan blade surface opposite said blade iron and having a hand gripping portion, and a locking portion configured to extend between said stop portion and said blade iron through said blade fastener mounting hole, said fastener being rotatable between a locked position locking said blade to said blade iron and an unlocked position unlocking said blade from said blade iron.

8. A The ceiling fan of claim 7 wherein said catch has a vertical portion extending through said catch mounting hole and a flange portion extending from said vertical portion in a position to overlay said fan blade surface opposite the blade iron.

* * * * *